US005823591A

United States Patent [19]

Rubinstein

[11] Patent Number: 5,823,591

[45] Date of Patent: Oct. 20, 1998

[54] GOLF-BALL RETRIEVER

[76] Inventor: Joseph Rubinstein, 20-3 America Way, Salem, Mass. 01970

[21] Appl. No.: 931,144

[22] Filed: Sep. 16, 1997

[51] Int. Cl.[6] ..... B63B 47/02

[52] U.S. Cl. ..... 294/19.2; 294/66.1

[58] Field of Search ..... 294/19.2, 55, 66.1; 56/328.1, 332, 400.01, 400.04, 400.11; 473/286

[56] References Cited

U.S. PATENT DOCUMENTS

| | | | |
|---|---|---|---|
| 698,226 | 4/1902 | Roberts | 294/19.2 |
| 704,848 | 7/1902 | Minton | 294/19.2 |
| 2,864,228 | 12/1958 | Griffith | 294/19.2 X |
| 3,717,371 | 2/1973 | Halone | 294/19.2 |
| 5,110,168 | 5/1992 | Petrillo | 294/19.2 |
| 5,368,350 | 11/1994 | Ader et al. | 294/19.2 |
| 5,575,519 | 11/1996 | Mansbridge | 294/19.2 |

FOREIGN PATENT DOCUMENTS

| | | | |
|---|---|---|---|
| 469482 | 7/1937 | United Kingdom | 294/19.2 |

*Primary Examiner*—Johnny D. Cherry
*Attorney, Agent, or Firm*—Weingarten, Schurgin, Gagnebin & Hayes LLP

[57] ABSTRACT

A golf ball retriever having a dual entry for receiving a golf ball. In an exemplary embodiment, the golf ball retriever includes a substantially rectangular open wire frame head having a plurality of sufficiently closed sides forming a receiving area capable of retaining a golf ball substantially therein and two openings on adjacent perpendicular sides that are capable of receiving a golf ball therethrough and into the receiving area. The invention also includes a stud for attaching a handle to the frame head.

7 Claims, 2 Drawing Sheets

FIG. 1
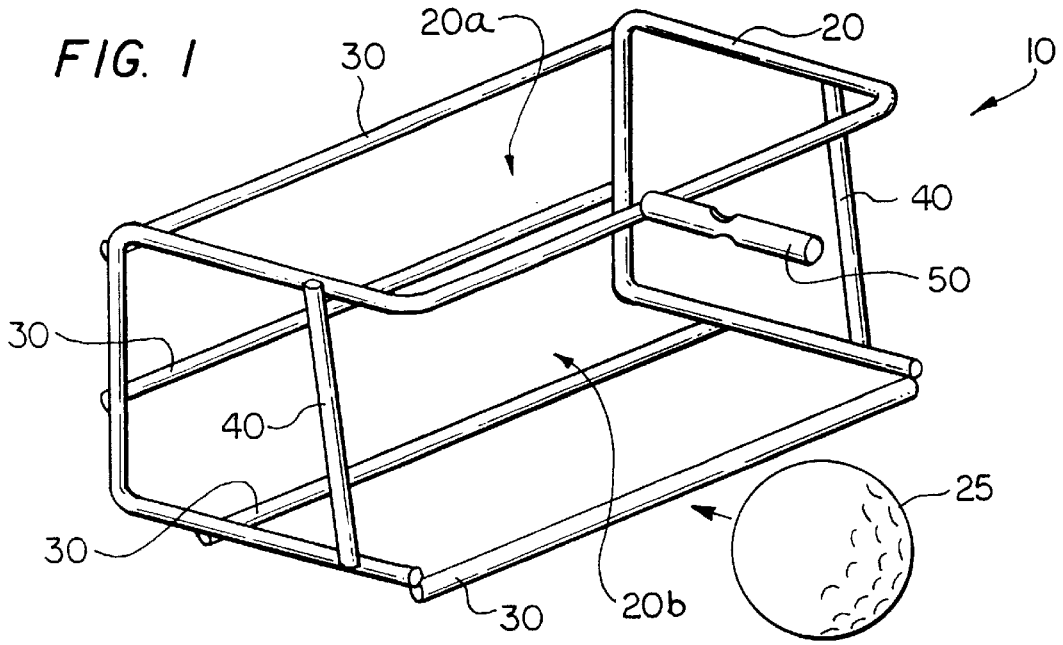
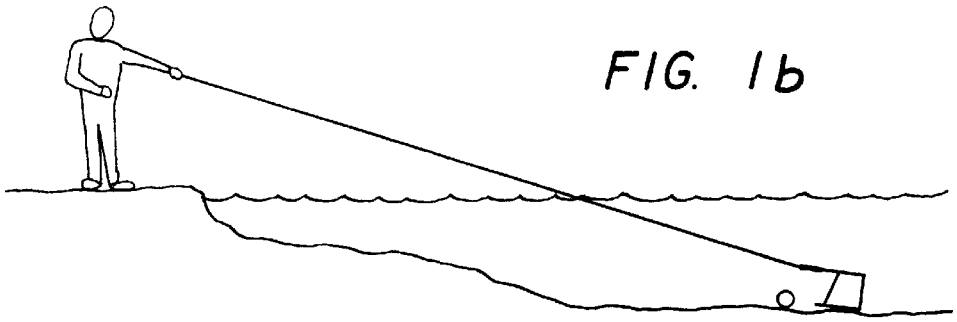
FIG. 1b
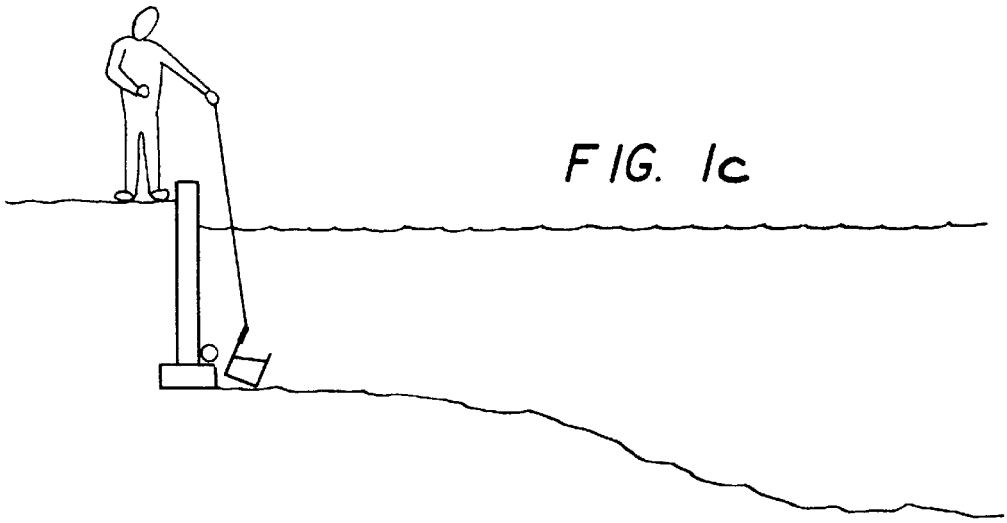
FIG. 1c

GOLF-BALL RETRIEVER

BACKGROUND OF THE INVENTION

The present invention relates to retrieving devices, and more particularly to a golf-ball retriever.

It is an inescapable aspect of the game of golf, that golf balls will eventually land in bodies of waters or thick brush and which would be unretrievable without some type of device or implement. Golf balls that are partially buried by mud or other substance can be especially difficult to retrieve.

Devices are generally known for retrieving golf balls. Frequently, golf balls are lost in thick brush, woods, pools of water, and other inaccessible areas from which they then need to be retrieved. Sometimes the golf balls become buried or partially covered by dirt, mud or brush. Known retrievers generally comprise a net or cup attached to a handle for scooping up a ball that is located in a body of water or otherwise unreachable. These retrievers can be difficult to manipulate in order to secure a golf ball and facilitate its return. These retrievers can also be awkward to handle when retrieving golf balls that are in difficult positions to see or unbury.

Prior art retrievers either have moving parts which are unreliable or nonmoving parts which require excessive manipulation and dexterity in order to capture and retrieve the golf ball. Prior art golf-ball retrievers with moving parts are extremely difficult to operate. Prior art golf-ball retrievers without moving parts are often difficult to manipulate because they require balancing the golf ball or moving the golf ball within the retriever itself in order not to lose the ball while retrieving it. Moreover, prior art golf-ball retrievers only have a single entry for a golf ball. These retrievers are generally cups or nets that have only one opening in which a golf ball can enter. These retrievers are limited in their ability to capture golf balls and require tricky and sometimes complicated manipulation of the retriever in order to retain the ball in the retriever. These retrievers can be very difficult to use with success.

It would be desirable to provide an easily manipulated golf-ball retriever having multiple entries for receiving a golf ball, wherein the golf ball will be retained while in the retrieving process. It would also be desirable to have a golf-ball retriever that has no moving parts to wear out, and is capable of fitting to a standard telescoping rod.

Additionally, it would be desirable to have a golf ball retriever that is rigid and durable enough to easily displace a partially covered golf ball for retrieving purposes.

BRIEF SUMMARY OF THE INVENTION

The present invention provides a retriever for golf balls which is easily manipulated and handled and has multiple openings for receiving a golf ball. The present invention includes an open wire frame or head having a plurality of sides which define a receiving area capable of retaining a golf ball. The frame has two openings on adjacent sides of the frame for allowing entry of a golf ball into the frame. Thus, the invention provides dual entry ways to permit capture of a golf ball by easy manipulation of the retriever. The frame is constructed of rigid members and is fitted to a handle, rod, or pole. There are no moving parts to wear out and the rigid nature of the device allows a user to easily recover a partially buried golf ball through either of the two openings.

BRIEF DESCRIPTION OF THE DRAWINGS

The invention will be more fully understood by reference to the following detailed description when considered in conjunction with the accompanying drawings, in which:

FIG. 1 is a diagram of an embodiment of a golf-ball retriever of the invention;

FIG. 1*b* is a side profile view of an embodiment of the invention shown in FIG. 1 capturing a golf ball in a one entry;

FIG. 1*c* is a side profile view of an embodiment of the invention shown in FIG. 1 capturing a golf ball in a another entry;

DETAILED DESCRIPTION OF THE INVENTION

Figure 2A:
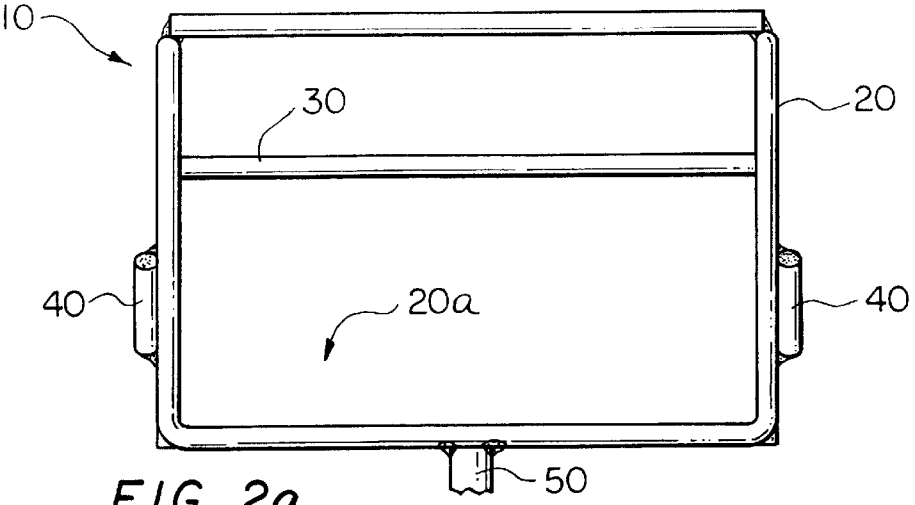
FIG. 2*a* is a top view of an embodiment of the invention shown in FIG. 1.

FIG. 1 is an illustration of a golf-ball retriever in accordance with the present invention. The golf-ball retriever 10 includes an open wire frame or head 20 having multiple sides. A first opening 20*a* is defined within the top side of frame 20, and a second opening 20*b* is defined within the front side of frame 20. Openings 20*a* and 20*b* are capable of receiving a golf ball 25 therethrough. The golf-ball retriever 10 further includes rigid frame members 30 disposed along the length of two sides of frame 20. Rigid side members 40 are disposed along the sides that are substantially perpendicular to the sides having frame members 30 disposed thereon. Rigid members 30 and 40 define a retaining area within frame 20.

The frame 20 and members 30 and 40 are of a material that is sufficiently rigid and resilient to withstand being dragged through water, mud, dirt, rocks, brush, and tree limbs. Frame 20 and members 30 and 40 can be metal wire, such as iron or aluminum, or can be any other durable material, such as plastic. The frame can be of welded construction or cast as a single unit. The golf-ball retriever 10 also includes a stud 50 for attaching a handle, rod, or pole 60 to the frame 20. In the illustrated embodiment shown in FIG. 2*d*, the stud 50 is a metal rod welded to the frame 20. The stud 50 can include recesses as shown in FIG. 2*d* into which a surrounding pole can be swaged or compressed for attachment of the frame head 20 to the pole or handle 60. The stud 50 can also be configured for use with a detachable handle 60. The handle can be telescoping or of a standard length. Other elements may be utilized to attach the head to the handle.

The golf-ball retriever 10 is used to retrieve golf balls from bodies of water and inaccessible areas. For example, when a golf ball is submerged in the middle of a pond, a person can attach the golf-ball retriever 10 to a telescoping pole and reach with the pole out into the water to the proximate location of the golf ball. The person can then drag the frame 20 along the bottom of the water to the location of the golf ball. The golf ball can enter through the opening 20*b* of the frame 20 where it will be retained within the area defined by the frame 20 and members 30 and 40 within the frame. The person would then retract the pole with the frame containing the golf ball until the golf ball was back in the possession of the person or on the land. No further manipulation of the frame would be required. The golf ball would be retained within the frame as it was dragged along or pulled through the water to the person. In another example, a golf ball that is in a hard to reach place, such as in water almost directly below a person, can be retrieved through use of the opening 20*a* of frame 20. The person can extend the golf-ball retriever into a body of water and place and push the frame 20 up against a trapped golf ball through opening 20*a* and retract the frame 20 whereby the golf ball will be retained within the retaining area formed by the frame 20 and members 30 and 40.

The present invention offers two entry points for easier retrieval of a golf ball without difficult manipulation. This configuration allows golf balls to be more easily captured and retained, without compromising retrievability of the golf balls. In addition, this configuration requires little or no additional manipulation of the frame in order to retain and retrieve a golf ball. Neither opening 20*a* or 20*b* interferes with the retainment of a golf ball, but actually facilitate the return of a golf ball.

Figure 2B:
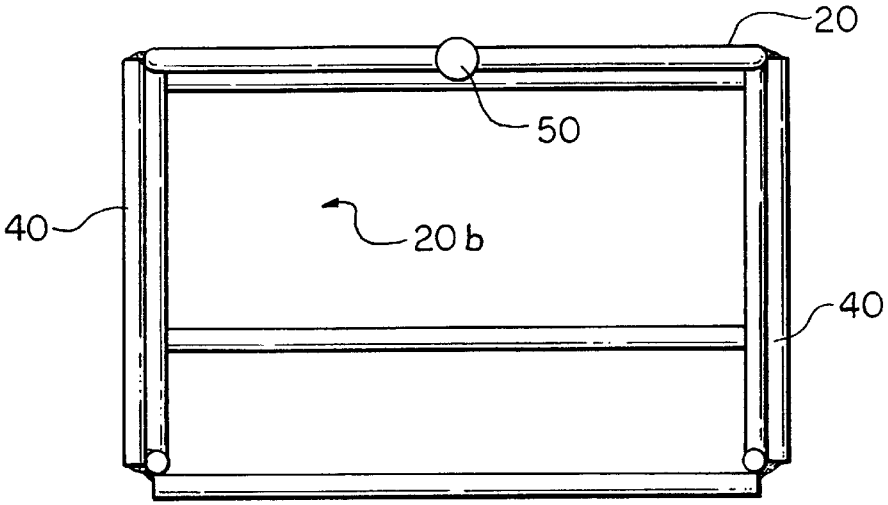
FIG. 2*b* is a front view of an embodiment of the invention shown in FIG. 1.
Figure 2D:
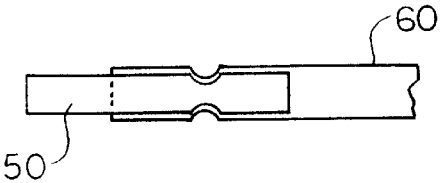
FIG. 2*d* is a view of a stud of an embodiment of the invention shown in FIG. 1.
Figure 2C:
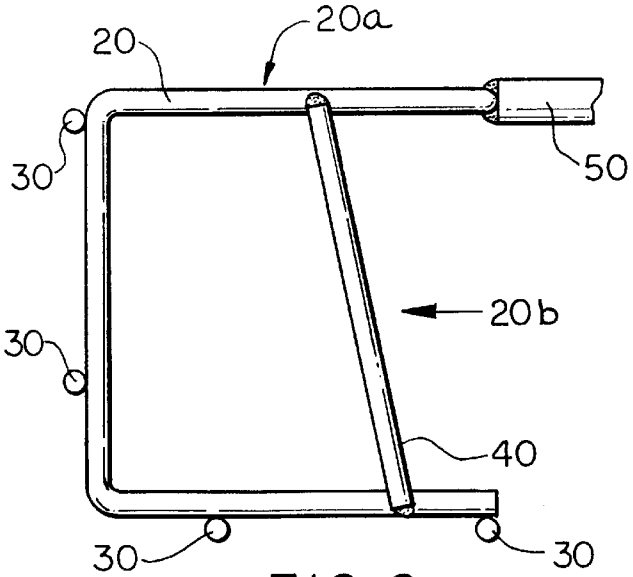
FIG. 2*c* is a side view of an embodiment of the invention shown in FIG. 1.

FIGS. 2*a*, 2*b*, and 2*c* taken together, show the interaction of the elements of the retriever 10 from different perspectives. FIG. 2*a* shows a top view of the golf-ball retriever 10. This figure shows opening 20*a* in the top of frame 20. Opening 20*a* is large enough to allow entry of a golf ball therethrough where it will be retained by members 30 and members 40 as shown in phantom in FIG. 2*c*. FIG. 2*b* shows a front view of the invention with the opening 20*b* in the front of frame 20. As a golf ball enters through opening 20*b* it is likewise retained by members 30 and 40 as shown in FIG. 2*c*. FIGS. 2*a*, 2*b*, and 2*c* further show an embodiment of the invention as shown in FIG. 1 having an attachment means 50 extending from frame 20. This attachment means is shown as a stud for receiving and attaching to a telescoping or other retrieving pole or rod. However, the attachment means 50 is not limited to a stud and can be any type of connector or attachment known in the art. Preferably, the stud 50 will be of a standard size and configuration to readily fit all standard telescoping rods.

The preferred embodiment of the present invention will comprise a frame 20 that is approximately 3 ½ inches wide and 2 ¼ inches long and having members 30 approximately 3 ½ inches long welded to opposite ends across the length of the frame 20 and spaced apart on two respective sides of the frame 20 by approximately 1 ½ inches. This spacing keeps a regulation size golf ball from escaping from the frame 20 while being retrieved. Members 40 will also be welded to opposite points on the sides of the frame 20, approximately 1 to 1 ¾ inches from the back of the frame 20. Members 40 are preferably disposed on an angle along the sides of frame 20. The spacing of members 40, like members 30, prevents a regular size golf ball from escaping through the sides of frame 20 during a retrieval. The front opening of the frame 20 will be approximately 2 to 2 ¼ inches wide. The top opening 20*a* will also have a width of approximately 2 to 2 ¼ inches. This configuration allows for entry of a golf ball through either of the openings 20*a* or 20*b* of frame 20 and retention of the golf ball within the frame 20 by members 30 and 40. Additionally, in a preferred embodiment, attachment means 50 will extend from the frame 20 at an angle of 0° to 20° and be able to attach to a variety of standard retrieving rods.

Although the invention has been shown and described with respect to exemplary embodiments thereof, various other changes, omissions and additions and form and detail thereof, may be made therein without departing from the spirit and scope of the invention. Accordingly, it is submitted that the invention should not be limited to the described embodiments but rather should be limited only by the appended claims.

What is claimed is:

1. A retriever for retrieving a golf ball, said retriever comprising:

a substantially rectangular fixed rigid wire frame head having a plurality of distinct sides defining a receiving area capable of retaining the golf ball substantially therein;

a first defined opening in a first distinct side of said rigid wire frame head capable of receiving the golf ball therethrough and into said receiving area;

a second defined opening in a second distinct side of said rigid wire frame head capable of receiving the golf ball therethrough and into said receiving area; and a stud extending from said rigid wire frame head for attaching a handle to said rigid wire frame head;

said first distinct side and said second distinct side of said rigid wire frame head adjacent and substantially perpendicular to each other;

said plurality of distinct sides adjacent said first distinct side and said second distinct side of said rigid wire frame head sufficiently closed to retain the golf ball substantially within said receiving area of said wire frame head.

2. The retriever of claim 1, wherein said rigid wire frame head includes fixed elongated rigid frame members disposed across the sides of said wire frame head for retaining a golf ball within said receiving area, said elongated frame members disposed to allow entry of a golf ball through said first or said second opening.

3. The retriever of claim 2, wherein said elongated rigid frame members are welded to said rigid wire frame head.

4. The retriever of claim 1, wherein a handle is detachably fastened to said stud.

5. The retriever of claim 1, wherein a handle is permanently attached to said wire frame head.

6. A retriever for a golf ball comprising:

a housing having a plurality of distinct sides including a front side and a top side;

a plurality of fixed rigid frame members attached from a first side of said housing to a parallel second side of said frame head;

a first rigid side member attached across the first side of said housing and a second rigid side member attached across the second side of said housing;

said plurality of fixed rigid frame members and said first and second rigid side members forming a retaining area for retaining the golf ball substantially within said housing;

said housing having a defined top opening in said top side and a defined front opening in said front side, said front opening and said top opening each capable of separately receiving the golf ball therethrough and into said retaining area of said housing;

all adjacent plurality of sides to said front side and said top side sufficiently closed to substantially retain the golf ball in said housing.

7. The retriever of claim 6, further comprising a connector on either of said front side or said top side of said housing, said connector capable of attaching a rod to said housing.

* * * * *